US005964585A

United States Patent [19]

Nakamura et al.

[11] Patent Number: 5,964,585

[45] Date of Patent: Oct. 12, 1999

[54] OIL BURNER FOR ENSURING COMBUSTION OF LONG-TERM STORED KEROSINE

[75] Inventors: Kenji Nakamura; Yasuyuki Tsuchimatsu; Osamu Niwa, all of Aichi-ken, Japan

[73] Assignee: Toyotomi Co., Ltd., Nagoya, Japan

[21] Appl. No.: 09/087,928

[22] Filed: Jun. 1, 1998

[30] Foreign Application Priority Data

May 30, 1997 [JP] Japan ..... 9-157920

[51] Int. Cl.[6] ..... F23N 5/00

[52] U.S. Cl. ..... 431/32; 431/121; 431/208; 431/333

[58] Field of Search ..... 431/3, 32, 121, 431/333, 208

[56] References Cited

U.S. PATENT DOCUMENTS

| | | | |
|---|---|---|---|
| 4,497,625 | 2/1985 | Petersen et al. | 431/208 |
| 4,533,316 | 8/1985 | Takino et al. | 431/121 |
| 4,614,493 | 9/1986 | Nakamura et al. | 431/341 |
| 4,767,316 | 8/1988 | Nakamura et al. | 431/121 |
| 4,770,627 | 9/1988 | Yoshino | 431/18 |
| 5,282,738 | 2/1994 | Oshima et al. | 431/3 |

*Primary Examiner*—Ira S. Lazarus
*Assistant Examiner*—Sara Raab
*Attorney, Agent, or Firm*—Pollock, Vande Sande & Amernick, R.L.L.P.

[57] ABSTRACT

An oil burner capable of ensuring normal combustion of quality-deteriorated kerosine. A burner body including a vaporization section is fed with fuel and air from a fuel pump and an air fan, respectively. A combustion control unit controls the fuel pump and air fan to control a combustion quantity in the burner body. The combustion control unit increases the combustion quantity to a combustion level sufficient to permit tar collected in the vaporization section to be burned at a predetermined time interval. Also, the combustion control unit keeps the combustion quantity increased to the combustion level for a predetermined period of time which permits tar collected in the burner body prior to an increase in combustion quantity to the combustion level to be substantially exhausted. This permits the combustion quantity to be intermittently increased, to thereby ensure substantial exhaustion of tar collected in the burner body.

11 Claims, 8 Drawing Sheets

OIL BURNER FOR ENSURING COMBUSTION OF LONG-TERM STORED KEROSINE

BACKGROUND OF THE INVENTION

This invention relates to an oil burner for kerosine stored for a long term (hereinafter referred to as "long-term stored kerosine"), and more particularly to an oil burner for ensuring normal combustion of quality-deteriorated kerosine such as kerosine changed into a macromolecular structure or highly polymerized (hereinafter referred to as "macromolecular kerosine" or "highly-polymerized kerosine") due to prolonged storage thereof, kerosine having deteriorated quality similar to such macromolecular kerosine or the like.

An oil burner of the type of automatically controlling a fuel combustion quantity which has been conventionally known in the art generally includes a burner body for combustion of an oil fuel such as kerosine, a fuel pump for feeding the fuel to the burner body, an air fan for feeding air to the burner body, and a combustion control unit for controlling the fuel pump and air fan to control the quantity of combustion in the burner body. Kerosine used as the fuel in such an oil burner comprises a combination of oil species within a predetermined range collected by distillation, resulting in a molecule of the kerosine being substantially varied in a wide range. Also, so-called carried-over kerosine which was purchased in the preceding year and carried over to the next year, kerosine excessively contacted with oxygen in air while keeping a cap of an oil tank open, kerosine exposed to an elevated temperature or the like is changed into a macromolecular structure or highly polymerized due to oxidation of the kerosine, a change in quality or properties thereof, or the like. Further, a molecular weight of kerosine is varied depending on a country. Thus, there are actually seen countries that often sell kerosine having quality similar to carried-over kerosine or kerosine deteriorated in quality to a degree sufficient to generate tar by combustion due to incorporation of naphtha thereinto. Unfortunately, the conventional oil burner fails to control combustion in view of quality of kerosine used.

Thus, the conventional oil burner, when quality-deteriorated kerosine such as carried-over kerosine which is deteriorated in quality due to high-polymerization is used as a fuel therefor, causes kerosine collected in a vaporization section of the burner body to be partially changed into tar. Unfortunately, the tar thus formed leads to abnormal combustion or a failure in satisfactory combustion such as incomplete combustion.

SUMMARY OF THE INVENTION

The present invention has been made in view of the foregoing disadvantage of the prior art.

Accordingly, it is an object of the present invention to provide an oil burner which is capable of ensuring normal combustion of quality-deteriorated kerosine.

It is another object of the present invention to provide an oil burner which is capable of selecting a combustion mode randomly or as desired which permits normal combustion of quality-deteriorated kerosine to be maintained.

It is a further object of the present invention to provide an oil burner which is capable of automatically selecting a combustion mode which ensures normal combustion of quality-deteriorated kerosine.

In accordance with the present invention, an oil burner for ensuring normal combustion of quality-deteriorated kerosine used as a fuel therefor is provided. The oil burner includes a burner body for burning the fuel which includes a vaporization section for vaporizing the fuel, a fuel pump for feeding the burner body with the fuel, an air fan for feeding the burner body with air, and a combustion control unit for controlling the fuel pump and air fan to control a combustion quantity in the burner body. The combustion control unit is constructed so as to increase the combustion quantity to a combustion level sufficient to permit tar collected in the burner body to be burned at a predetermined time interval and keep the combustion quantity increased to the combustion level for a predetermined period of time which permits tar collected in the burner body prior to an increase in combustion quantity to the combustion level to be substantially exhausted. Combustion control which increases the combustion quantity to the combustion level is referred to as "cleaning combustion control" herein in comparison with normal-or steady-state combustion control.

In the present invention, the cleaning combustion control permits effective burning of kerosine of which at least a part has been changed into tar in the vaporization section of the burner body, to thereby ensure normal combustion in the oil burner. The cleaning combustion control is carried out only within a predetermined period of time, to thereby prevent a substantial variation in temperature in a room or atmosphere in which the oil burner is placed. In particular, when the combustion control unit is constructed so as to carry out steady-state combustion control in which the combustion quantity is controlled so as to permit a temperature of the atmosphere in which the oil burner is placed to be kept at a set temperature and so as not to carry out the steady-state combustion control during the predetermined period of time at every predetermined time interval, the steady-state combustion control positively prevents a substantial variation in room temperature.

The term "predetermined time interval" used herein for increasing the combustion quantity in the cleaning combustion control indicates either "a fixed time interval" or "a variable time interval", which is selected depending on a capacity of the oil burner, the manner of control of the combustion control unit and quality of kerosine to be used. The term "predetermined period of time" or "predetermined time" for keeping the combustion quantity at the combustion level indicates either "a fixed period of time" or "a variable period of time", which is likewise selected depending on a capacity of the oil burner, the manner of control of the combustion control unit and quality of kerosine to be used.

A degree to which the combustion quantity is increased in the cleaning combustion control indicates a degree sufficient to ensure burning of tar collected in the burner body. However, in order to reduce a period of time for the cleaning combustion control to the utmost, the amount of combustion which permits the vaporization section to be heated to a maximum one of the temperature levels detected may be defined to be the combustion quantity increased to the combustion level. Such a combustion quantity may be predetermined by experiment. However, the amount of combustion which permits the vaporization section to be heated to the maximum temperature level is varied depending on an ambient environment. In order to avoid the problem, a temperature detection means may be arranged for detecting a temperature of the vaporization section of the burner body and outputting, to a storage means, a command which permits the storage means to store therein an associated relationship for providing the combustion level obtained when the detected temperature of the vaporization section is at the maximum temperature level, wherein the combustion quantity is increased according to the associated relation. Alternatively, a maximum combustion level in the burner body may be defined to be the combustion quantity increased to the combustion level.

In general, a user of an oil burner is hard to judge quality of kerosine used, therefore, the cleaning combustion control is periodically or intermittently carried out irrespective of quality of kerosine used. When carried-over kerosine is used as the fuel, a user would be able to judge quality of kerosine based on a storage term thereof in this instance, a fuel variation signal generating means may be constituted by a manual change-over switch arranged in a manner to be operable from an exterior of the oil burner and kept at a changed-over state when it is manually changed over, wherein the fuel variation signal is outputted when the manual change-over switch is kept at a particular changed-over state. Such construction eliminates waste of the fuel.

When the fuel variation signal generating means is constituted by the manual change-over switch as described above, there would be likelihood that a failure in operation of the switch occurs. In order to avoid the problem, the fuel variation signal generating means may be constituted by an electrical insulating member arranged in a passage which permits flowing of gas containing tar therethrough, a resistance detection circuit for detecting a variation in electrical resistance between predetermined portions of the electrical insulating member and a discrimination circuit for outputting the fuel variation signal when the resistance detected is at a predetermined level or less. Such construction permits the cleaning combustion control to be automatically carried out, to thereby fully prevent waste of the fuel.

BRIEF DESCRIPTION THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, an oil burner according to the present invention will be described hereinafter with reference to the accompanying drawings.

Figure 1:
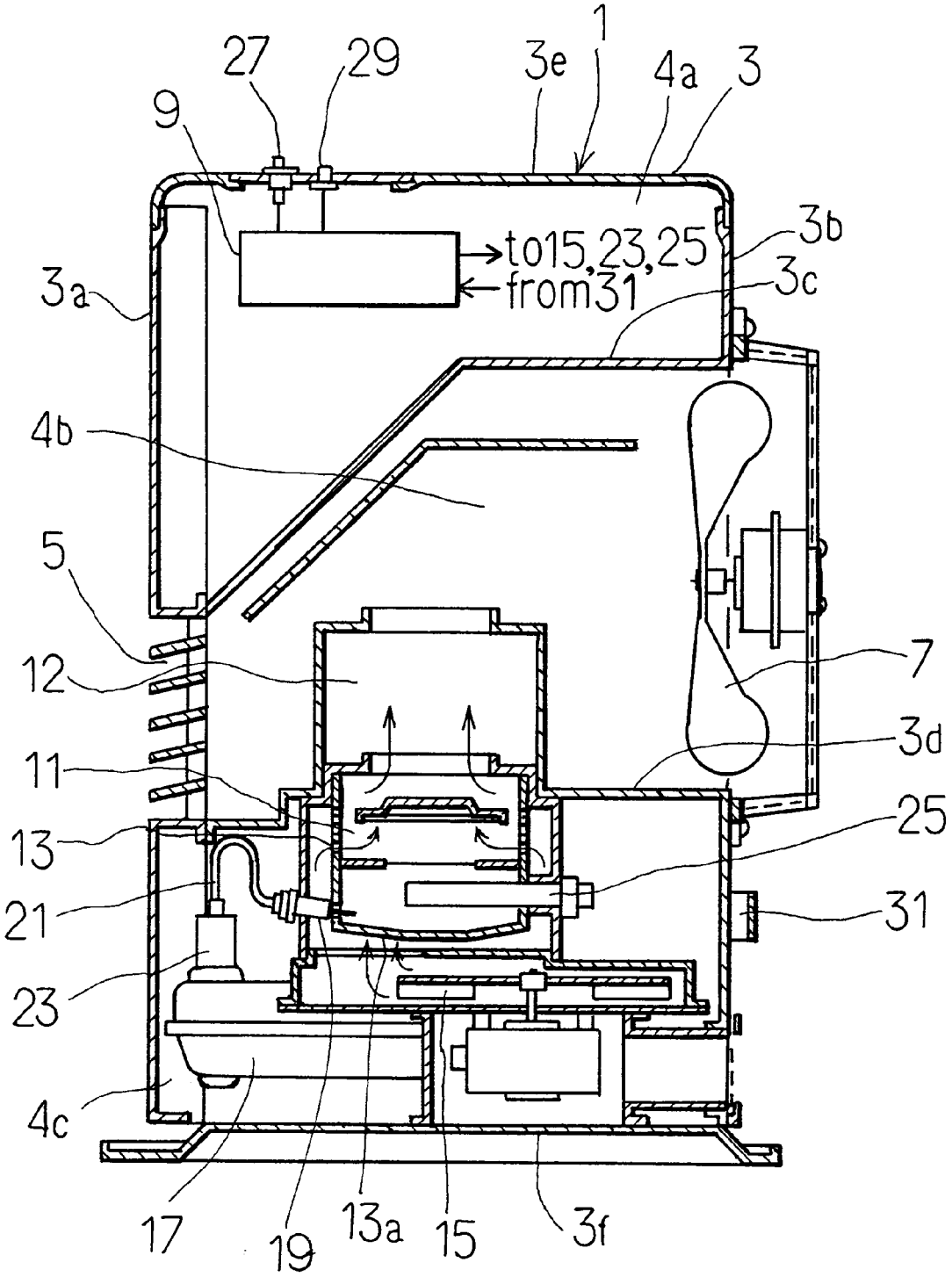
FIG. 1 is a schematic sectional view showing an embodiment of an oil burner according to the present invention.

Referring first to FIG. 1, an embodiment of an oil burner according to the present invention is illustrated. An oil burner of the illustrated embodiment which is generally designated at reference numeral 1 is generally called a fan heater and includes a housing 3. The housing 3 includes a front wall 3*a* provided with a hot-air blowoff port 5 and a rear wall 3*b* provided with a convection fan 7. The housing 3 is provided therein with partition walls 3*c* and 3*d*. Also, the housing 3 includes a top plate 3*e*, which cooperates with the partition wall 3*c* to define an upper receiving space 4*a* therebetween for receiving a controller 9 therein. Between the partition walls 3*c* and 3*d* is defined an air passage 4*b*. The housing 3 further includes a bottom plate 3*f*, which cooperates with the partition wall 3*d* to define a lower receiving space 4*c* therebetween for receiving a combustion structure therein.

The combustion structure received in the lower receiving space 4*c* includes a pot-type burner body 11 including a pot 13 provided in a lower portion thereof with a vaporization section 13*a*, an air fan 15 for feeding combustion air to the pot 13 of the burner body 11, a fuel tank 17, a fuel pump 23 for feeding fuel or kerosine to the pot 13 of the burner body 11 from the fuel tank 17 through a nozzle 19 and a fuel pipe 21, and an ignition heater 25 mounted on the pot 13 so as to carry out both preheating and ignition of the fuel in the pot 13. The burner body 11 includes a combustion chamber 12, which is arranged in the air passage 4*b*. The combustion structure may be constructed in such a manner as disclosed in U.S. Pat. Nos. 4,770,627, 4,767,316 or 4,614,493.

The top plate 3*e* of the housing 3 is provided thereon with switches 27 and 29 each of which functions to feed a control signal to the controller 9. More specifically, the switch 27 acts as an operation switch for providing an ignition signal for ignition of the oil burner and an extinction signal for fireextinguishing of the oil burner. The switch 29 constitutes a temperature setting means for setting a temperature of an ambient atmosphere in which the oil burner is placed. The rear wall 3*b* of the housing 3 is provided thereon with a temperature sensor 31 for detecting a temperature of the ambient atmosphere in which the oil burner is placed.

Figure 2:
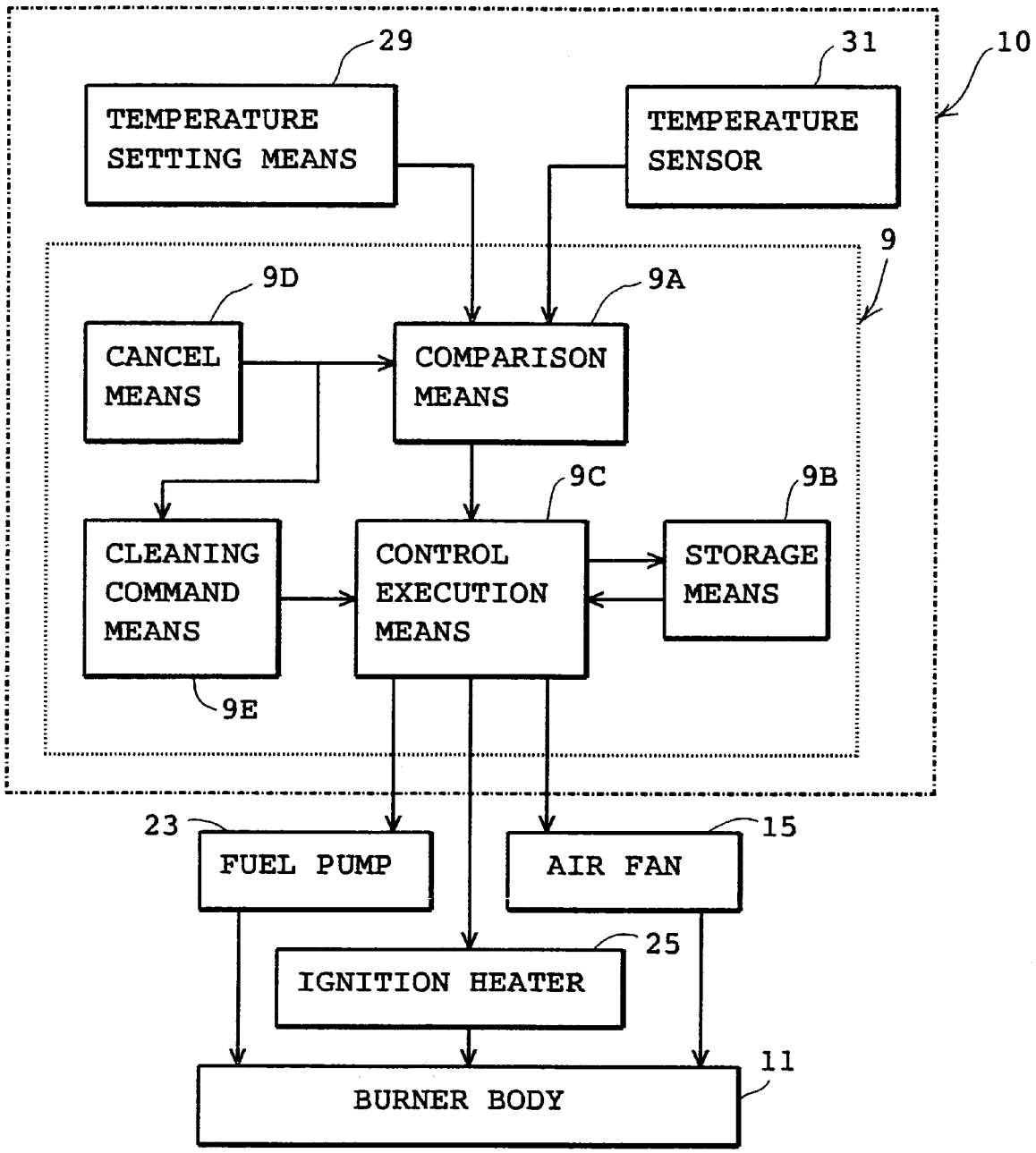
FIG. 2 is a block diagram showing a combustion control section incorporated in the oil burner of FIG. 1.

A combustion mechanism of the oil burner 1 of the illustrated embodiment may be constructed in such a manner as shown in FIG. 2. In FIG. 2, reference numeral 10 designates a combustion control unit, which is essentially constituted by a microcomputer and a memory each incorporated in the controller 9 and functions to mainly control the fuel pump 23, air fan 15 and ignition heater 25 to control a combustion quantity in the burner body 11. The controller 9 includes a comparison means 9A, a storage means 9B, a control execution means 9C, a cancel means 9D and a cleaning command means 9E.

The comparison means 9A functions to calculate a difference $\Delta T$ between a detection temperature Td detected by the temperature sensor 31 and a set temperature Ts set by a temperature setting means 29' constituted by the switch 29 ($Ts-Td=\Delta T$). Then, the storage means 9B is stored therein with relationship associated between a discharge rate Vo of fuel from the fuel pump 23 and an air feed rate Va at which air is fed from the air fan 15, which ensures normal combustion free from generation of any incomplete combustion gas depending on the combustion quantity. The associated relationship is an air/fuel ratio and determined experimentally or theoretically. In general, there is a tendency that an increase in difference $\Delta T$ leads to an increase in both fuel discharge rate Vo and air feed rate Va, whereas a reduction in difference $\Delta T$ causes a decrease in fuel discharge rate Vo and air feed rate Va. The associated relationship stored in the storage means 9B may be stepwise. Instead, it may be linear or continuous.

The control execution means 9C is constructed so as to control the fuel pump 23 and air fan 15 according to the associated relationship read out of the storage means 9B. First of all, the control execution means 9C reads out the associated relationship from the storage means 9B which provides a raised combustion level when the difference ΔT is zero or until it has a value approaching zero, to thereby control the fuel pump 23 and air fan 15. In general, the raised combustion level is a maximum combustion quantity. Then, the control execution means 9C reduces the combustion quantity when the difference ΔT has a value approaching zero. More specifically, the control execution means reads out the associated relationship from the storage means 9B which provides the amount of combustion required for keeping a temperature of the atmosphere in which the oil burner 1 is placed at the set temperature, resulting in the fuel pump 23 and air fan 15 being controlled depending on the associated relationship thus read out. Also, in the Illustrated embodiment, the control execution means 9C is also constructed so as to control the ignition heater 25 depending on operation of the operation switch 27 (FIG. 1).

More particularly, when the operation switch 27 is turned on, the control execution means 9C reads out the associated relationship from the storage means 9B which provides the maximum combustion quantity, to thereby feed a drive circuit for the fuel pump 23 and air fan 15 with a drive signal and feed the ignition heater 25 with a turn-on signal. Combustion control in a steady state or normal- or steady-state combustion control is carried out in such a manner that the fuel pump 23 and air fan 15 are controlled according to the associated relationship which provides the maximum combustion quantity until the difference ΔT outputted from the comparison means 9A approaches zero from any positive value (or has a value approaching zero). When the difference ΔT is negative, the current combustion quantity is stepwise or continuously reduced until the difference is zero. Then, when the difference ΔT is positive, the current combustion quantity is stepwise or continuously increased. Such operation is suitably repeated, to thereby cause the difference to be ultimately zero, resulting in a temperature of the atmosphere in which the oil burner 1 is placed reaching the set temperature. At this state, the combustion quantity is at a level lowered below the maximum combustion quantity and the fuel pump 23 and air fan 15 are controlled under the associated relationship which keeps the combustion quantity at the lowered level.

The cancel means 9D includes a first timer means for repeatedly counting timer time corresponding to a predetermined time interval t1 and is constructed so as to cancel an output of the comparison means 9*a* during a period of time for which the first timer means counts a predetermined period of time t2 after the timer means counts the timer time 2. The cleaning command means 9E is constructed so as to count the predetermined time t2 by means of a timer means incorporated therein while the cancel means 9D is canceling the output of the comparison means 9A, to thereby feed the control execution means 9C with the associated relationship which provides a combustion quantity sufficient to ensure burning of tar collected in the burner body 11 during the predetermined time. The associated relationship may be previously stored in the cleaning command means 9E. Alternatively, it may be read cut of the storage means 91B and then fed to the control execution means 9C. In the illustrated embodiment, the cleaning command means 9E is constructed so as to feed the control execution means 9C with the associated relationship between the fuel pump 23 and the air fan 15 which provides the maximum combustion quantity during a period of time for which the cancel means 9D cancels the output of the comparison means 9A.

Such construction permits the combustion control unit 10 to carry out cleaning combustion control as well as regular or normal temperature control. The cleaning combustion control functions to permit the combustion quantity to be increased to a combustion level sufficient to permit tar collected in the burner body 11 at the predetermined time interval t1 and keep the combustion quantity increased to the combustion level for the predetermined period of time t2 which ensures substantial burning of tar collected in the burner body 11 prior to an increase in combustion quantity to the combustion level described above.

Supposing that such quality-deteriorated kerosine due to prolonged storage thereof as often locally sold in the United States or Europe is used as a fuel for the oil burner; the time interval t1 is set to be between 1.5 hours and 3 hours when the maximum combustion quantity is selected as the combustion quantity at the increased combustion level. When such kerosine as sold in Europe is used as the fuel, the time interval t1 would be preferably about 2 hours. Also, the predetermined time t2 for keeping the combustion quantity at the increased combustion level is set to be 1 to 8 minutes and preferably about 1 to 2 minutes.

Figure 3:
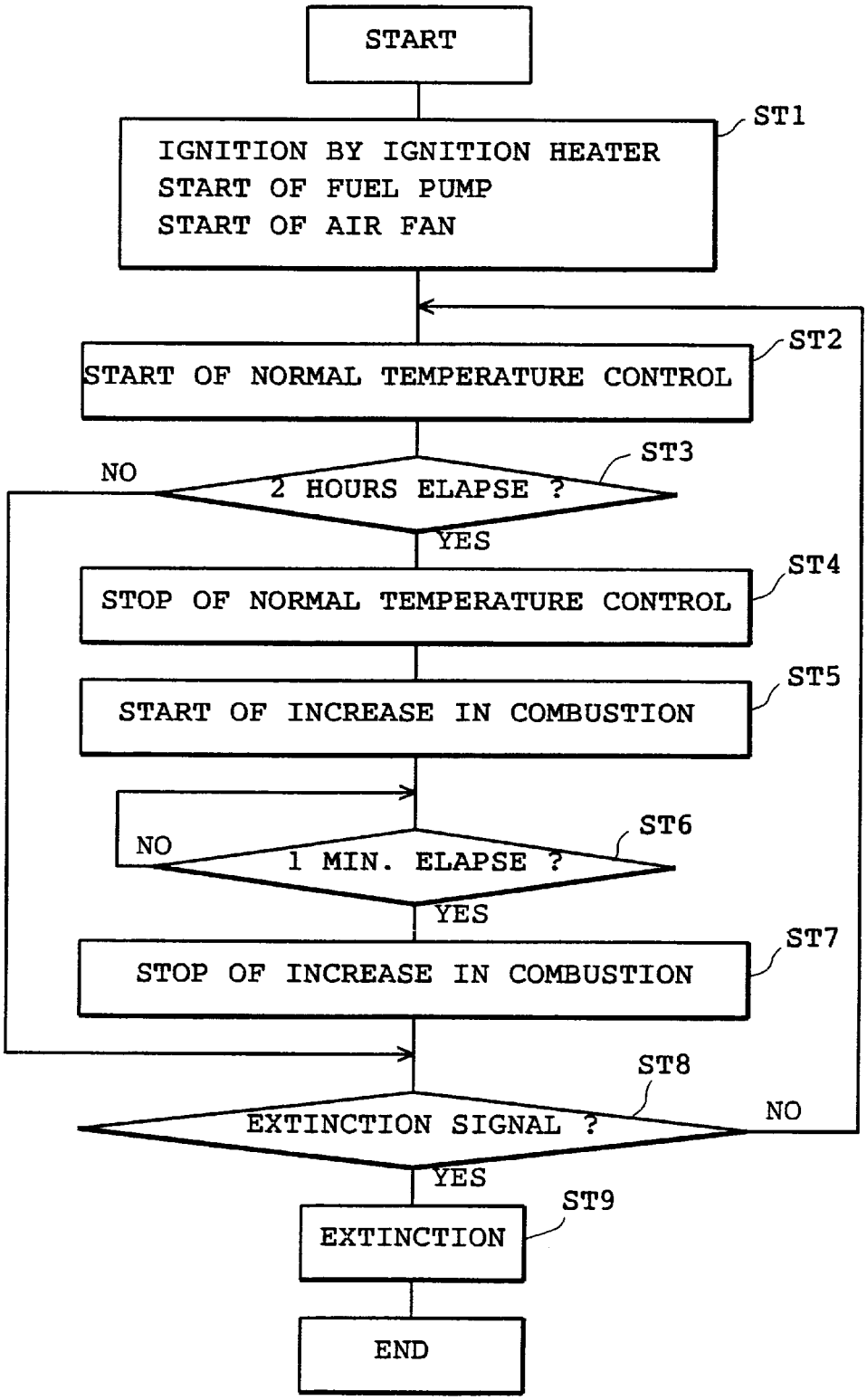
FIG. 3 is a flow chart showing operation of the oil burner of FIG. 1.

Operation of the oil burner 1 constructed as shown in FIGS. 1 and 2 is shown in FIG. 3 by way of example, wherein the time interval t1 and predetermined time t2 are set to be 2 hours and 1 minute, respectively. First, when the operation switch 27 is turned on, the control execution means 9C feeds the ignition heater 25 with a turn-on signal in a step ST1, so that the ignition heater 25 preheats the burner body 11, resulting in the vaporization section. 13*a* of the burner body 11 being heated to an elevated temperature. Upon preheating of the vaporization section 13*a*, operation of the fuel pump 23 and air fan 15 is started. More particularly, kerosine is fed in the form of droplets to the vaporization section 13*a* of the pot 13 of the burner body 11 from the nozzle 19 extending above the vaporization section 13*a* of the pot 13 and air is fed from the air fan 15 into the pot 13 of the burner body 11. The air is guided as indicated at arrows in FIG. 1. The pot 13 is formed at an upper portion thereof with a plurality of through-holes via which air is fed into the pot 13. Kerosine thus fed is vaporized in the vaporization section 13*a* heated to an elevated temperature and ignited by the ignition heater 25. The kerosine thus ignited is burned in the combustion chamber 12. The convection fan 7 is driven concurrently with or subsequently to starting of combustion of the kerosine This causes combustion gas at an elevated temperature discharged from the combustion chamber 12 to be taken into air flowing through the air passage 4*b* and then outwardly exhausted from the housing 3 through the hot-air blowout port 5.

When combustion is started in the burner body 11 as described above, the normal- or steady-state combustion control is started in a step ST2. In the steady-state or steady combustion control, the comparison means 9A outputs the difference ΔT between the detection temperature Td detected by the temperature sensor 31 and the set temperature Ts set by the temperature setting means 29' constituted by the switch 29 (Ts−Td=ΔT ). Then, the control execution means 9C reads out the associated relationship between the fuel pump 23 and the air fan 15 which initially provides the maximum combustion quantity from the storage means 9B, to thereby control the fuel pump 23 and air fan 15 according to the associated relationship thus read. This maintains the combustion quantity until the difference (Ts−Td=ΔT ) approaches zero from any positive value or has a value approaching zero. Then, when the detection temperature Td or room temperature reaches a level of the set temperature Ts or above, the burner body 11 is decreased in combustion quantity. During the time, the current combustion quantity is reduced while the difference ΔT Is kept negative. Further, when the difference ΔT is positive, the associated relationship which increases the current combustion quantity is read out of the storage means 9B. Thereafter, when the difference ΔT is rendered constant at zero, the combustion quantity is maintained. At this time, the vaporization section 13*a* of the pot 13 has heat feedbacked from the burner body 11, to thereby be kept at a temperature of a constant level.

Concurrently with starting of the operation, the timer means incorporated in the cancel means 9D starts counting of the time interval t1 of 2 hours, during which the steady-state combustion control is continued until the counting is completed.

Then, counting of the time interval t1 is completed in a step ST3, the steady-state combustion control is interrupted in a step ST4. The cancel means 9D cancel an output of the comparison means 9A for the predetermined period of time t2, resulting in such interruption or stop of the temperature control being executed. When the steady-state combustion control Is thus stopped in the step ST4, an increase in combustion quantity is started in a step ST5, resulting in the cleaning combustion control being started. More specifically, the cleaning command means 9E feeds the control execution means 9C with the associated relationship between the fuel pump 23 and the air fan 15 which ensures burning of tar collected in the burner body 11 during the predetermined period of time t2 for which the cancel means 9D cancels the output of the comparison means 9A. In the illustrated embodiment, the time t2 is set to be 1 minute and the combustion quantity is set at the maximum combustion level. The control execution means 9C carries out control of the fuel pump 23 and air fan 15 according to the associated relationship. Combustion at the maximum combustion level is continued for 1 minute. When 1 minute elapses in a step ST6, output from the cleaning command means 9E is stopped, resulting in an increase in combustion quantity in a step ST7 being stopped.

The cleaning combustion control permits quality-deteriorated kerosine to be used as a fuel for the oil burner. Use of quality-deteriorated kerosine as the fuel causes insufficient feedback of heat to the vaporization section 13*a* of the burner body 11, leading to a reduction in temperature of the vaporization section 13*a*, resulting in kerosine fed in the form of droplets to the vaporization section 13*a* being partially changed into tar. The tar thus produced covers the vaporization sections 13*a*, leading to abnormal combustion or a failure in combustion. The illustrated embodiment constructed as described above ensures effective vaporization and combustion of quality-deteriorated kerosine partially changed into tar by the cleaning combustion control.

When an increase in combustion quantity is stopped in the step ST7, the operation advances to a step ST8, so that unless the extinction signal is generated when the operation switch 27 is turned off is outputted, the operation is returned to the step ST2, resulting in the above-described procedure from the step ST2 to the step ST8 being repeated. When the extinction signal is outputted during the control, the operation advances from the step ST8 to a step ST9, so that fire-extinguishing operation such as stop of the fuel pump and/or air fan or the like is executed.

The illustrated embodiment is so constructed that the cleaning combustion control is periodically or intermittently carried out irrespective of the quality of kerosine used, in view of the fact that it is generally hard for a user of an oil burner to judge the quality of kerosine used.

Figure 4:
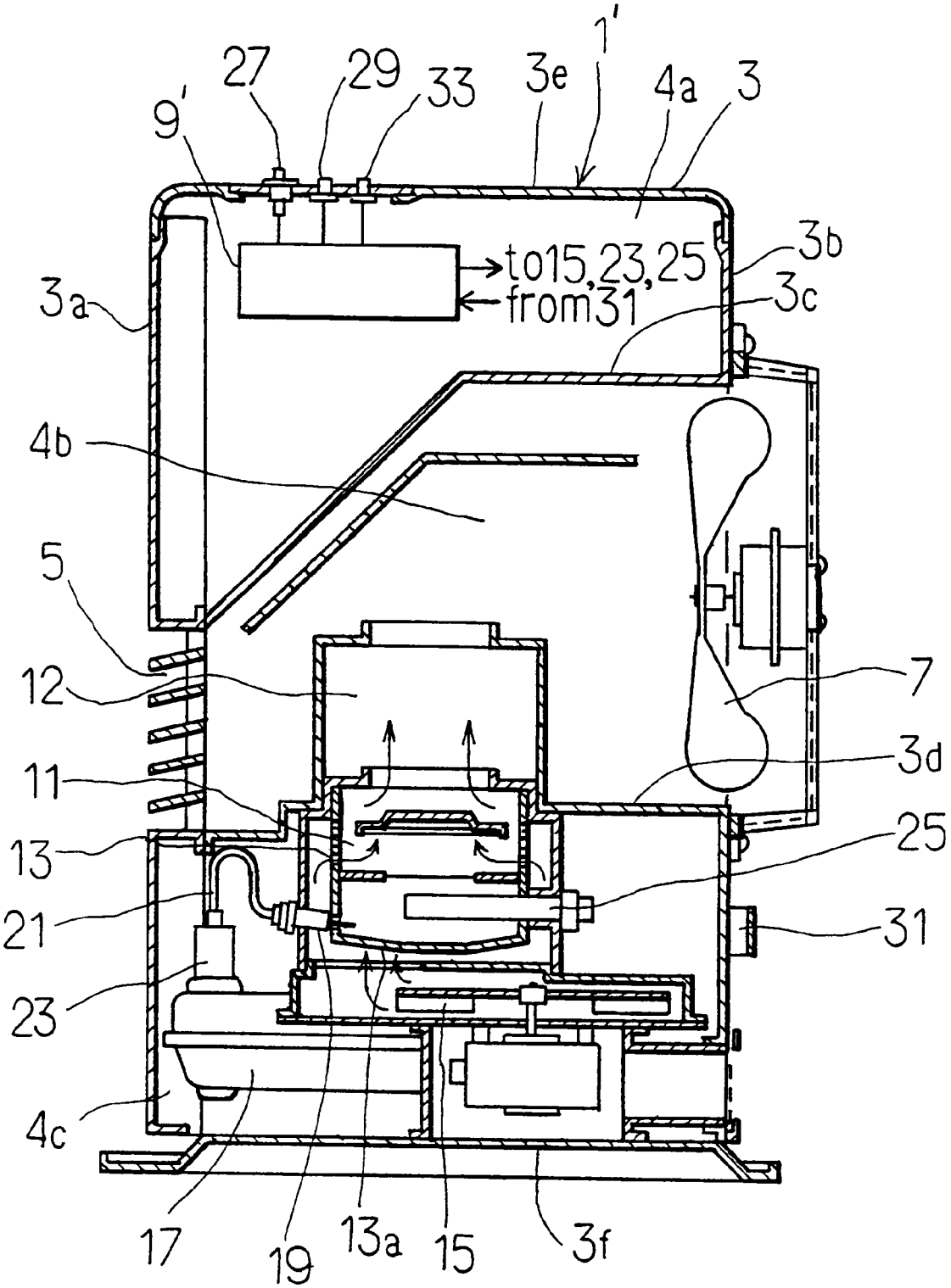
FIG. 4 is a schematic sectional view showing another embodiment of an oil burner according to the present invention in which a manual change-over switch acting as a fuel variation signal generating means Is incorporated.
Figure 5:
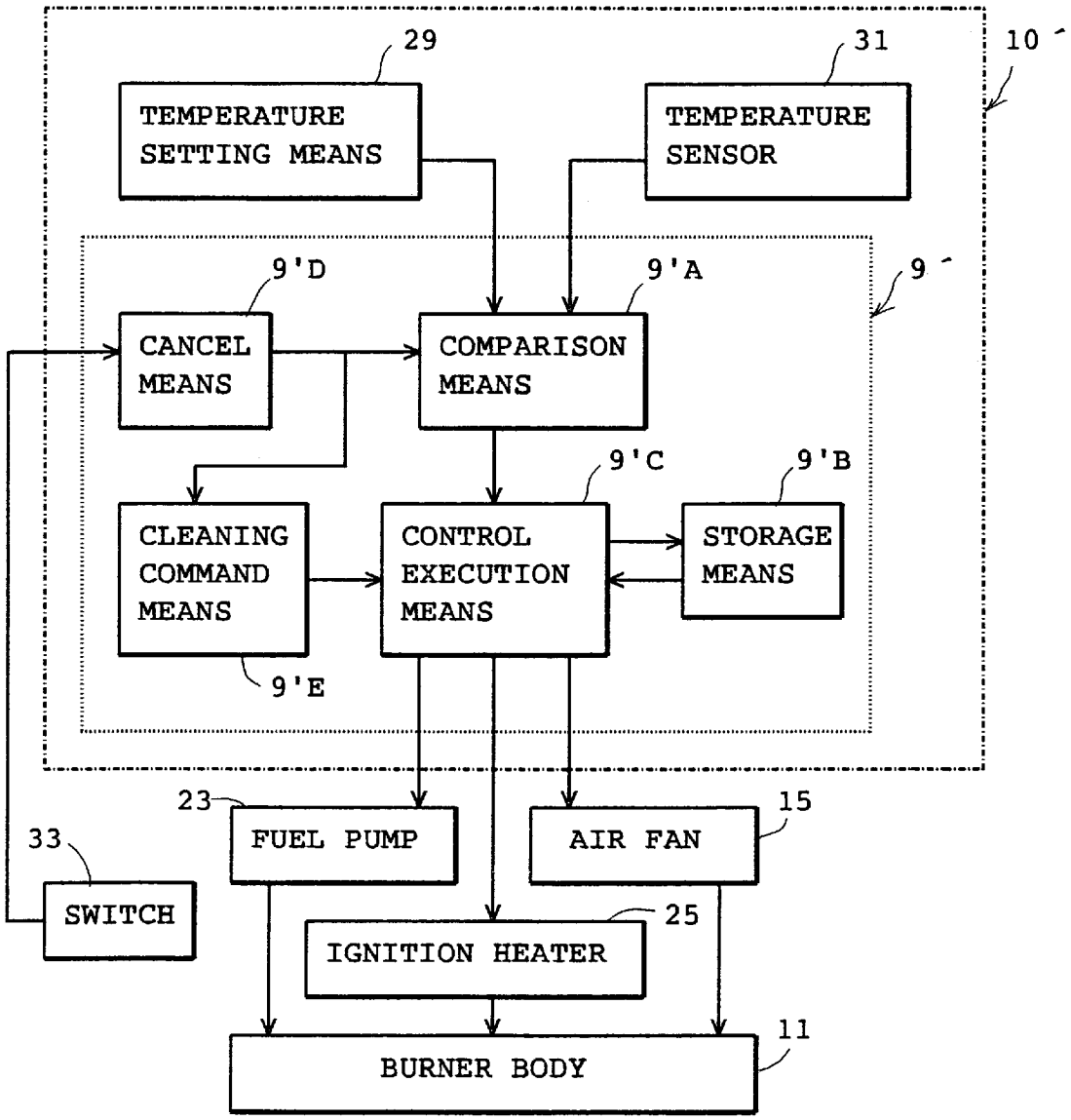
FIG. 5 is a block diagram showing a combustion control section incorporated in the oil burner of FIG. 4.

Alternatively, the present invention is so constructed that a fuel variation signal generating means is arranged for generating a fuel variation signal which indicates quality-deteriorated kerosine, resulting in the cleaning combustion control being carried out only during a period of time for which the fuel variation signal is generated. FIGS. 4 and 5 show another embodiment of an oil burner according to the present invention. An oil burner of the illustrated embodiment which is generally designated at reference numeral 1' is so constructed that a manual change-over switch 33 is used as such a fuel variation signal generating means as described above. The illustrated embodiment may be constructed in substantially the same manner as the embodiment of FIG. 1, except that the manual change-over switch 33 kept at a changed-over state once it is manually changed over is arranged on a top plate 3*e* of a housing 3. A controller 9' is constructed in substantially the same manner as the controller 9 shown in FIG. 2, except that a cancel means 9'D is operable only when the switch 33 is kept turned on and is prevented from being operated when the switch 33 is kept turned on.

The illustrated embodiment is constructed supposing that so long as a storage term of kerosine is indicated, a user of an oil burner will be able to judge quality of kerosine based on the storage term. Thus, in the illustrated embodiment, the cleaning combustion control is carried out only when the manual change-over switch 33 acting as the fuel variation signal generating means is kept turned on. Such construction permits the cleaning combustion control to be carried out as desired, to thereby eliminate waste of kerosine due to unnecessary cleaning combustion control.

Figure 6:
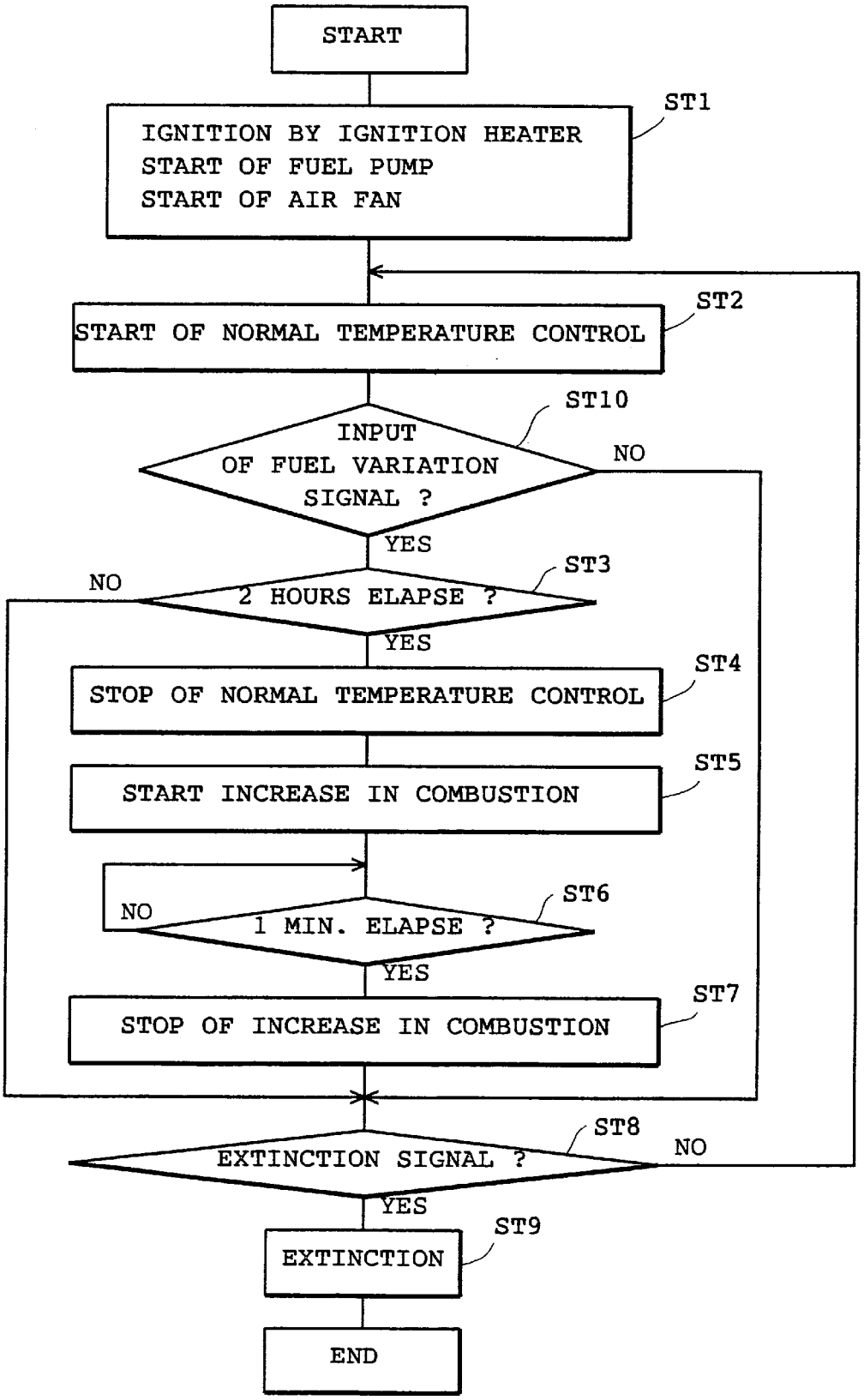
FIG. 6 is a flow chart showing operation of the oil burner of FIG. 4.

The oil burner shown in FIGS. 4 and 5 may be operated in such a manner as shown in FIG. 6. In FIG. 6, a step ST10 is inserted between a step ST2 and a step ST3. In the step ST10, it is judged whether the manual change-over switch 33 is turned on, resulting in a fuel variation signal being inputted to the cancel means 9'D. As a result, steps ST3 to ST7 are executed only when the cancel means 9'D is fed with the fuel variation signal. The remaining part in FIG. 6 may be constructed in substantially the same manner as shown in FIG 2. Thus, a combustion control unit 10' carries out cleaning combustion control only during a period of time for which it receives the fuel variation signal.

In the illustrated embodiment, use of kerosine increased in quality while keeping the switch 33 turned on does not cause any significant problem as in the first embodiment shown in FIGS. 1 and 2, because the cleaning combustion control is merely carried out for a short period of time. In particular, when temperature control takes place by normal- or steady-state combustion control, a temperature of an atmosphere in which the oil burner is placed is by the steady-state combustion control, so that the cleaning combustion control does not cause a variation in temperature of the atmosphere.

Figure 7:
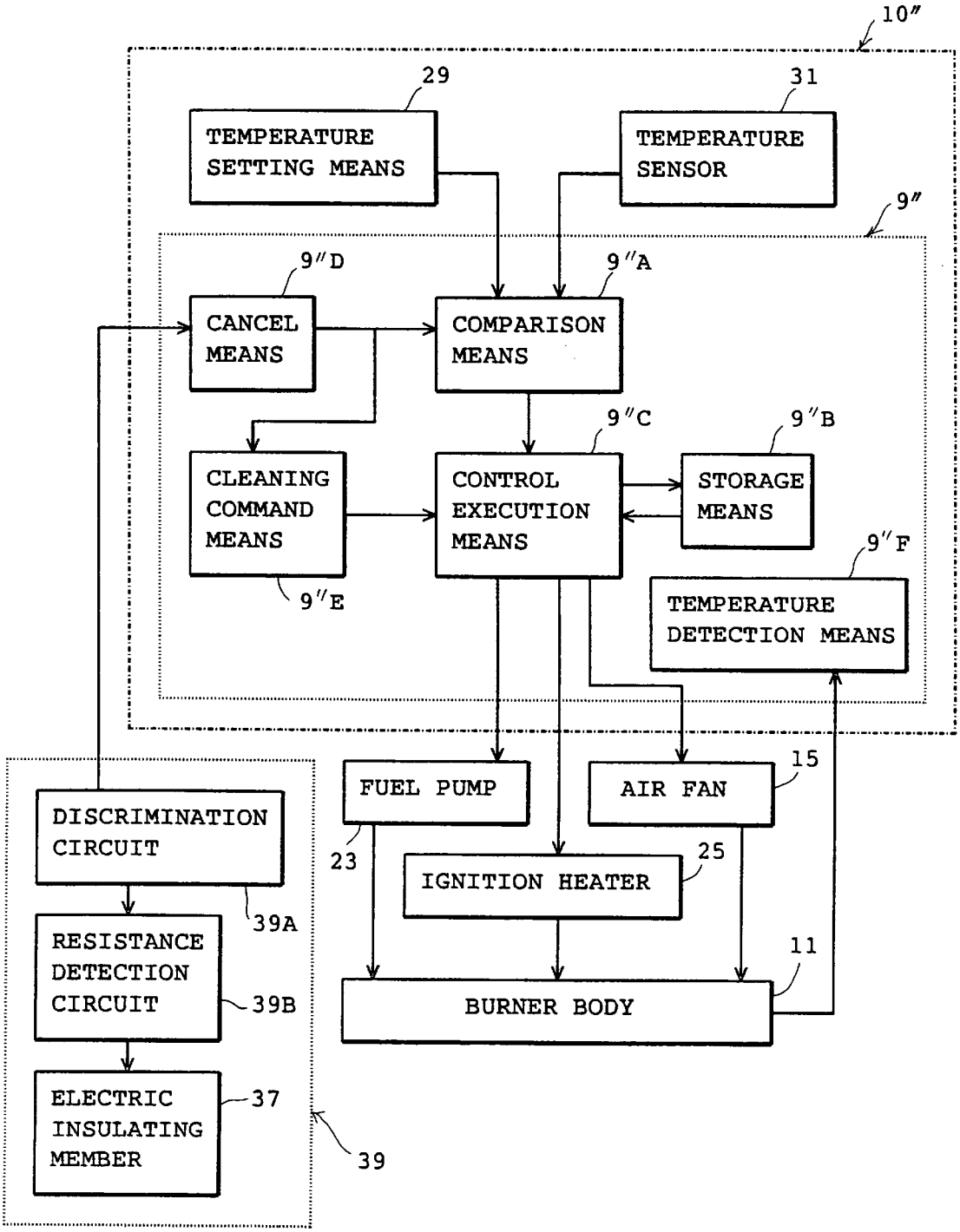
FIG. 7 is a block diagram showing a combustion control section incorporated in a further embodiment of an oil burner according to the present invention.

Referring now to FIG. 7, a further embodiment of an oil burner according to the present invention is illustrated, wherein a fuel variation signal generating means 39 is constituted by a circuit. An oil burner of the illustrated embodiment Is constructed in a manner different from the embodiment shown in FIG. 4 in that any switch corresponding to the manual change-over switch 33 is eliminated therefrom. A pot 13 is provided on an outer wall of a bottom thereof with a temperature sensor (FIG. 4). A controller 9"

is constructed in substantially the same manner as the controller 9' shown in FIG. 5. Thus, the controller 9" permits a cancel means 9"D to be operable only during a period of time for which a fuel variation signal generating means 39 outputs a fuel variation signal and to be kept from operating during a period of time for which the fuel variation signal generating means 39 is kept from generating the fuel variation signal.

Figure 8:
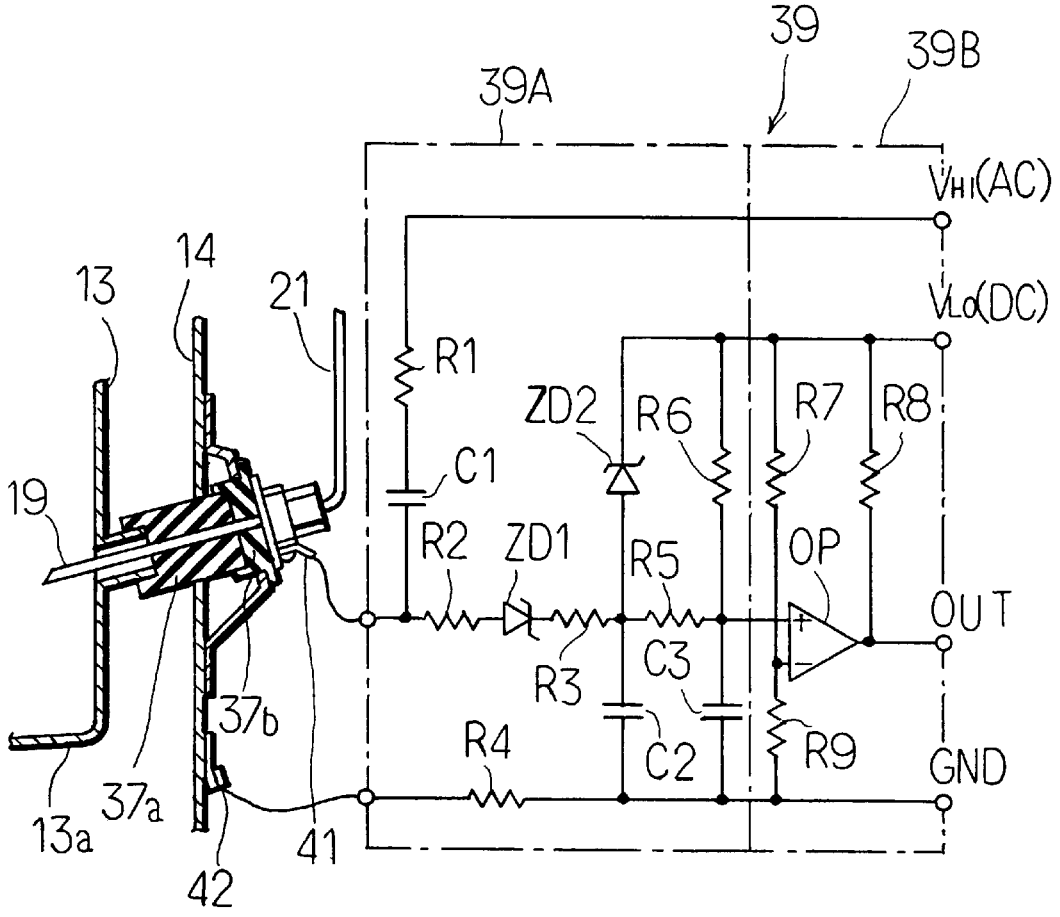
FIG. 8 is a circuit diagram showing a fuel variation signal generating means by way of example.

The fuel variation signal generating means 39 includes an electric insulating member 37 arranged in a passage through which gas containing tar is guided, a resistance detection circuit 39B for detecting a variation in electric resistance between predetermined portions of the insulating member 37, and a discrimination circuit 39A for outputting a fuel variation signal when the resistance detected is equal to or less a predetermined level. The fuel variation signal generating means 39 may be constructed in such a manner as shown in FIG. 8, wherein R1 to R9 each designate a resistor, C1 to C3 each are a capacitor, ZD1 and ZD2 each are a Zener diode, and OP is a comparator. The electric insulating member 37 includes a bushing 37*a* made of an insulating material and fitted in a base of a nozzle 19 arranged on a distal end of a fuel pipe 21 and a seat 37*b* made of an insulating material. The electric insulating member 37 is arranged between the pot 13 of a burner body 11 and an outer frame 14 made of metal. The fuel pipe 21 has a terminal 41 electrically connected thereto, to which an AC voltage is applied. The outer frame 14 which has a voltage of a level identical with that of the pot 13 applied thereto has a ground terminal 42 electrically connected thereto. Between the pot 13 and the outer frame 14 is guided a part of each of air fed from an air fan and combustion gas discharged from the pot 13. In this case, use of quality-deteriorated kerosine causes tar to be collected on the bottom of the pot 13, leading to a failure in normal combustion and inclusion of tar in combustion gas, resulting in a part of combustion gas which contains tar entering a space between the pot 13 and the outer frame 14. Thus, tar containing a large amount of carbon adheres to a surface of the bushing 37*a* with a lapse of time, leading to a reduction in electric resistance of the surface of the bushing 37*a* or insulation thereof. An AC voltage of a commercial frequency is applied between the terminals 41 and 42. Thus, such a reduction in electric resistance or insulation of the surface of the bushing 37*a* leads to a reduction in voltage of a half wave of an AC voltage applied to the Zener diode ZD1. This results in a voltage varied in relationship reversely proportional to the resistance of the surface of the bushing 37*a* being inputted to a non-inversion input terminal or positive terminal of the comparator OP constituted by an operational amplifier. The voltage inputted is gradually reduced with a reduction in electric resistance of the surface of the bushing 37*a*. The comparator OP outputs a fuel variation signal through an output terminal thereof when the voltage inputted is reduced as compared with a reference voltage inputted to an inversion input terminal of the comparator OP.

When the fuel variation signal generating means 39 thus outputs the fuel variation signal, the cancel means 9"D of the controller 9" is rendered operable, so that cleaning combustion control is started according to procedures like those in the above-described embodiments. An increase in temperature in the pot 13 of the burner body 11 likewise leads to an increase in temperature of the space between the pot 13 and the outer frame. Such an increase in temperature in the space permits tar adhering to the surface of the bushing 37*a* to be removed or eliminated therefrom, leading to an increase in resistance of the surface of the bushing 37, resulting in stopping the fuel variation signal generating means 39 from outputting the fuel variation signal. As a result, the cancel means 9"D is rendered non-operable, leading to execution of steady-temperature control and therefore normal temperature control.

In the illustrated embodiment, a temperature detected by the temperature sensor 35 arranged on the outer surface of the bottom of the pot 13 is processed in a temperature detection means 9"F. The temperature detection means 9"F functions to detect a temperature of the vaporization section 13*a* of the burner body 11. Also, the temperature detection means 9"F, when the temperature detected is at a maximum level, functions to permit the storage means 9"B to store therein combustion conditions (associated relationship) providing a temperature of the maximum level. The combustion conditions (associated relationship) are stored as combustion conditions (associated relationship) used at the time when the combustion quantity is increased. Thus, the cleaning combustion control increases the combustion quantity according to the combustion conditions stored in the storage means 9"B. Such construction of the illustrated embodiment that the combustion quantity increased by the cleaning combustion control is permitted to reach a maximum combustion level set by a combustion control unit 10" positively increases a temperature of the vaporization section 13*a* of the burner body to the maximum level, so that tar collected in the vaporization section 13*a* of the burner body 11 may be positively rapidly eliminated. The cleaning combustion control would often render the temperature unstable. In order to avoid such a problem, the combustion conditions may be kept unvaried using a temperature detected by the temperature sensor 35 during the cleaning combustion control. Use of the temperature detection means 9"F may be likewise applied to the embodiments shown in FIGS. 1 to 6. Also, the fuel variation signal generating means 39 may be applied to the embodiment shown in FIGS. 4 to 6. In this instance, outputs of the switch 33 and fuel variation signal generating means 39 may be fed through the OR circuit to the cancel means 9"E.

In normal operation of the oil burner, feeding of electric power to an ignition heater 25 is interrupted after ignition in the burner body. Alternatively, even after the ignition, the ignition heater 25 Is fed with electric power to ensure an increase in temperature of the vaporization section 13*a* by means of heat of the ignition heater 25.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An oil burner for ensuring normal combustion of quality-deteriorated kerosine used as a fuel therefor, comprising:

a burner body for burning the fuel which includes a vaporization section for vaporizing the fuel;

a fuel pump for feeding said burner body with the fuel;

an air fan for feeding said burner body with air; and a combustion control unit for controlling said fuel pump and air fan to control a combustion quantity in said burner body;

said combustion control unit being constructed so as to increase said combustion quantity to a combustion level sufficient to permit tar collected in said burner body to be burned at a predetermined time interval and keep said combustion quantity increased to said combustion level for a predetermined period of time which permits tar collected in said burner body prior to an increase in combustion quantity to said combustion level to be substantially exhausted.

2. An oil burner as defined in claim 1, wherein said combustion control unit is constructed so as to carry out steady-state combustion control in which said combustion quantity is controlled so as to permit a temperature of an atmosphere in which the oil burner is placed to be kept at a set temperature and so as not to carry out said steady-state combustion control during said predetermined period of time at every said predetermined time interval.

3. An oil burner as defined in claim 2, wherein said combustion control unit is constructed so as to carry out steady-state combustion control in which said combustion quantity is controlled in such a manner that combustion is started at a raised combustion level and said combustion quantity is varied so as to keep the temperature of said atmosphere at said set temperature after the temperature of said atmosphere approaches said set temperature; and the amount of combustion which permits said vaporization section of said burner body to be heated to a maximum temperature level is defined to be said combustion quantity increased to said combustion level.

4. An oil burner as defined in claim 3, wherein said combustion control unit includes a temperature detection means for detecting a temperature of said vaporization section of said burner body and outputting, to a storage means, a command which permits said storage means to store therein an associated relationship between a discharge rate of fuel from said fuel pump and an air feed rate at which air is fed from said air fan for obtaining said combustion level when a detected temperature of said vaporization section is at said maximum temperature level;

said combustion quantity being increased according to said associated relationship.

5. An oil burner as defined in claim 1, wherein said combustion control unit is constructed so as to carry out steady state control in which said combustion quantity is controlled in such a manner that combustion is started at a raised combustion level and said combustion quantity is varied so as to keep the temperature of said atmosphere at said set temperature after the temperature of said atmosphere approaches said set temperature; and the maximum amount of combustion in said burner body is defined to be said combustion quantity increased to said combustion level.

6. An oil burner as defined in claim 5, wherein said timer time is between 1.5 hours and 3 hours and said predetermined period of time is between 1 minutes and 8 minutes.

7. An oil burner as defined in claim 1, wherein said combustion control unit includes:

a temperature setting means for setting a predetermined temperature;

a temperature sensor for detecting a temperature in an atmosphere in which the oil burner is placed;

a comparison means for providing a difference between the temperature detected by said temperature sensor and the predetermined temperature set by said temperature setting means;

a storage means for storing therein associated relationship between a fuel discharge rate and an air feed rate at which air is fed from said air fan, which ensures combustion free from generation of any incomplete combustion gas depending on the combustion quantity;

a control execution means for controlling said fuel pump and air fan according to said associated relationship read out of said storage means, to thereby increase the combustion quantity to a raised combustion level until said difference approaches zero from any positive value, decrease the combustion quantity after said difference is zero or negative, and then increase the combustion quantity after said difference is positive, resulting in the temperature of said atmosphere being kept at said set temperature;

a cancel means including a timer means for repeatedly counting timer time corresponding to said predetermined time interval and constructed so as to cancel an output of said comparison means after said timer means counts said timer time; and a cleaning command means for feeding said control execution means with said associated relationship during a period of time for which said cancel means cancels the output of said comparison means, said associated relationship increasing said combustion quantity to said combustion level.

8. An oil burner for ensuring normal combustion of quality-deteriorated kerosine used as a fuel therefor, comprising:

a burner body for burning the fuel which includes a vaporization section for vaporizing the fuel;

a fuel pump for feeding said burner body with the fuel;

an air fan for feeding said burner body with air;

a combustion control unit for controlling said fuel pump and air fan to control a combustion quantity in said burner body; and a fuel variation signal generating means for generating a fuel variation signal indicating that the fuel is quality-deteriorated kerosine;

said combustion control unit being constructed so as to increase said combustion quantity to a combustion level sufficient to permit tar collected in said burner body to be burned at a predetermined time interval and keep said combustion quantity at said combustion level for a predetermined period of time which permits tar collected in said burner body prior to an increase in combustion quantity to said combustion level to be substantially exhausted, while said combustion control unit is receiving said fuel variation signal.

9. An oil burner as defined in claim 8, wherein said combustion control unit is constructed so as to carry out steady state control in which said combustion quantity is controlled in such a manner that combustion is started at a raised combustion level and said combustion quantity is varied so as to keep the temperature of said atmosphere at said set temperature after the temperature of said atmosphere approaches said set temperature; and the amount of combustion which permits said vaporization section to be heated to a maximum temperature level is defined to be said combustion quantity increased to said combustion level.

10. An oil burner as defined in claim 8, wherein said fuel variation signal generating means comprises a manual change-over switch arranged in a manner to be operable from an exterior of the oil burner and kept at a changed-over state when it is manually changed over; and said fuel variation signal is outputted when said manual change-over switch is kept at a particular changed-over state.

11. An oil burner as defined in claim 8, wherein said fuel variation signal generating means comprises an electrical insulating member arranged in a passage which permits pass of gas containing tar therethrough, a resistance detection circuit for detecting a variation in electrical resistance between predetermined portions of said electrical insulating member and a discrimination circuit for outputting said fuel variation signal when the resistance detected is at a predetermined level or less.

* * * * *